US012258862B2

(12) United States Patent
Wang et al.

(10) Patent No.: US 12,258,862 B2
(45) Date of Patent: Mar. 25, 2025

(54) EXPERIMENTAL SYSTEM FOR SURROUNDING ROCK CRACK EVOLUTION AND WATER INRUSH DISASTER CHANGE IN TUNNEL EXCAVATION OF NEAR-COVERED KARST CAVE

(71) Applicant: Linyi University, Linyi (CN)

(72) Inventors: Hailong Wang, Linyi (CN); Chuanyang Jia, Linyi (CN); Guibin Zhang, Linyi (CN); Xiaoyuan Song, Linyi (CN); Xizhen Sun, Linyi (CN); Keming Liu, Linyi (CN); Xianbin Yu, Linyi (CN); Wei Li, Linyi (CN)

(73) Assignee: Linyi University, Linyi (CN)

( * ) Notice: Subject to any disclaimer, the term of this patent is extended or adjusted under 35 U.S.C. 154(b) by 197 days.

(21) Appl. No.: 18/179,357

(22) Filed: Mar. 6, 2023

(65) Prior Publication Data

US 2024/0301795 A1 Sep. 12, 2024

(51) Int. Cl.
*E21D 9/00* (2006.01)

(52) U.S. Cl.
CPC ..... *E21D 9/003* (2013.01)

(58) Field of Classification Search
CPC ..... E21D 9/003; G01N 3/12; G01M 5/005; G01M 99/007
See application file for complete search history.

(56) References Cited

U.S. PATENT DOCUMENTS 11,835,431 B1 * 12/2023 Zhang ..... G01M 99/008
2019/0383714 A1 * 12/2019 Li ..... G01N 3/12

FOREIGN PATENT DOCUMENTS

| | | | |
|---|---|---|---|
| CN | 108225929 | * | 6/2018 |
| CN | 105466712 | * | 8/2018 |
| CN | 109377849 | * | 2/2019 |
| CN | 105974056 | * | 3/2019 |
| CN | 111208015 | * | 5/2020 |
| CN | 107144470 | * | 8/2020 |
| CN | 112146912 | * | 12/2020 |

* cited by examiner

*Primary Examiner* — Carib A Oquendo
(74) *Attorney, Agent, or Firm* — Birchwood IP

(57) ABSTRACT

The present invention relates to the technical field of disaster model experiment of underground engineering, and more particularly to an experimental system for surrounding rock crack evolution and water inrush disaster change in a tunnel excavation of a near-covered karst cave. The experimental system includes a base, an upper crossbeam, standing columns, an experimental cabin, guide rails, a tunnel excavation device and an experimental control system. By setting a tunnel excavation device instead of the traditional manual excavation experimental system, the step-by-step excavation of the tunnel is realized. A camera inside the tunnel mold collects real-time images of the whole process of tunnel excavation. The front side plate is separated from the whole experimental cabin, such that the deformation and damage of the front side of the physical model can be directly observed.

4 Claims, 3 Drawing Sheets

EXPERIMENTAL SYSTEM FOR SURROUNDING ROCK CRACK EVOLUTION AND WATER INRUSH DISASTER CHANGE IN TUNNEL EXCAVATION OF NEAR-COVERED KARST CAVE

CROSS-REFERENCE TO RELATED APPLICATIONS

This application claims the benefit and priority of Chinese Patent Application Number 202210640478.5, filed on Jun. 8, 2022, the disclosures of which are incorporated herein by reference in their entireties.

TECHNICAL FIELD

The present invention relates to the technical field of disaster model experiment of underground engineering, and more particularly to an experimental system for surrounding rock crack evolution and water inrush disaster change in a tunnel excavation of a near-covered karst cave.

BACKGROUND

In China, different areas of limestone are distributed in almost every province. Specifically, the limestone exposed out of surface area reaches about 1.3 million square kilometers in total, accounting for about 13.5% of China's total area, while the limestone buried in the ground is more extensive, which is a common hydrogeological environment in the process of tunnel construction. As the product of corrosion and erosion, karst is changeable in development, variable in size and different in shape. The disturbance of tunnel excavation breaks the original mechanical equilibrium state of surrounding rock. Under the superposition of stress and water pressure to the waterproof rock mass, new cracks are generated and original cracks are expanded, resulting in that the confined water existing in karst enters rapidly into the tunnel along the crack channels to cause water inrush disasters. If the position, scale and shape of karst can be determined accurately before encountering karst, its stability can be analyzed in the process of tunnel construction, and further scientific and reasonable disposal measures are chosen, then the occurrence of water inrush disasters can be avoided. Therefore, the study on the characteristics of surrounding rock crack evolution in the tunnel excavation of a near-covered karst cave is of great significance to find the principle of water inrush disaster in karst cave.

The prior effective research approaches for surrounding rock crack evolution and water inrush in the tunnel excavation of the near-covered karst cave mainly include theoretical analysis, numerical simulation, field experiment, physical model experiment and others. Due to the complexity of geological conditions, theoretical analysis and numerical simulation methods have some limitations, and fail to guide specific engineering excavation. The field experiment has to face a bad environment, leading to long period and high cost.

In the prior art, the physical model is manually excavated, so it is difficult to realize the step-by-step excavation of the tunnel. Moreover, in the process of tunnel excavation, the broken rock masses may fall down to hinder the smooth excavation of the tunnel. The real-time camera system of the physical model is set outside the tunnel, which limits its capacity for capturing effective information. The shape of the karst cave in the physical model experiment is quite different from that in practice, and is often simplified. The experimental cabin of the physical model has the problem of inconvenient laying and disassembly, and it is difficult to realize the real-time image collection in the tunnel in the whole process of tunnel excavation.

In view of the above, the present invention provides an experimental system for surrounding rock crack evolution and water inrush disaster change in a tunnel excavation of a near-covered karst cave to solve the aforementioned problems.

SUMMARY

An objective of the present invention is to provide an experimental system for surrounding rock crack evolution and water inrush disaster change in a tunnel excavation of a near-covered karst cave, so as to solve the problems raised in the above background.

In order to achieve the above objective, the present invention provides the following technical solution. An experimental system for surrounding rock crack evolution and water inrush disaster change in a tunnel excavation of a near-covered karst cave includes a base, an upper crossbeam, standing columns, an experimental cabin, guide rails, a tunnel excavation device and an experimental control system.

The standing columns are symmetrically arranged on the base, one end of each of the standing columns is inserted in the base, and the other end of each of the standing columns penetrates the upper crossbeam to form a reaction frame.

Preferably, the experimental cabin includes a bottom plate, a front side plate, a rear side plate, a left side plate, a right side plate and a top plate. The bottom plate of the experimental cabin is placed directly on the base. The front side plate and the rear side plate are symmetrically arranged on symmetrical sides of the base, respectively. The left side plate and the right side plate are symmetrically arranged on the other symmetrical sides of the base, respectively. A tunnel excavation port is symmetrically arranged at a middle position of the front side plate and the rear side plate, and a shape of the tunnel excavation port is set according to an actual shape of a tunnel. The left side plate and the right side plate are symmetrically provided with equidistant installation grooves for installing a horizontal loading cylinder. A horizontal loading pressure head is installed on the loading cylinder, and the horizontal loading pressure head directly provides a horizontal load for a physical model in the experimental cabin. The top plate is centered symmetrically and equidistantly, and is connected to a vertical loading pressure head of the vertical loading cylinder. The vertical loading pressure head directly provides a vertical load for the physical model in the experimental cabin. The vertical loading cylinder is installed on the upper crossbeam. In a process of performing horizontal and vertical loading on the physical model at the same time, in order to avoid that the horizontal loading pressure head and the vertical loading pressure head squeeze each other, left and right sizes of the vertical loading pressure head are smaller than left and right sizes of the experimental cabin. However, in order to improve an overall tightness of the experimental cabin, a closed baffle is installed above the inside of the left side plate and the right side plate, and is fixed on the left side plate and the right side plate by bolts.

Preferably, the guide rails include a set of inner guide rails and a set of outer guide rails. The inner guide rails are configured for an overall movement of the experimental cabin, and the outer guide rails are configured for a separate movement of the front side plate of the experimental cabin. The set of inner guide rails is symmetrically fixed on two sides of the base, and the set of outer guide rails is symmetrically fixed on two sides of the base. Mobile lifting wheels are respectively arranged on the inner guide rails, and the mobile lifting wheels are symmetrically fixed on the bottom plate of the experimental cabin. When the whole experimental cabin is required to be moved, the lifting hydraulic cylinders above the mobile lifting wheels are started to lift the whole experimental cabin by 3 to 5 mm away from the base 1. At this time, the experimental cabin is completely supported by the mobile lifting wheels, a horizontal pushing hydraulic cylinder is started, and the whole experimental cabin is horizontally moved by relying on the telescopic action of the horizontal pushing hydraulic cylinder. Ordinary moving wheels are arranged on the outer guide rail, and the ordinary moving wheels are symmetrically fixed at a bottom of a triangular gantry. The triangular gantries are fixed on left and right sides of the front side plate by bolts. After an experiment of the physical model is completed, without damaging the physical model, the front side plate is driven by the ordinary moving wheels to be separated from the experimental cabin, such that a front side of the physical model is observed directly. In order to prevent the pressure head from failing to be centered in a vertical loading process due to back and forth movement of the experimental cabin, preferably, a limiter is arranged on the base for positioning the experimental cabin.

Preferably, the tunnel excavation device includes a moving base, a hydraulic telescopic cylinder and a tunnel mold. Universal wheels are symmetrically arranged at the bottom of the moving base to facilitate the free adjustment of the position of the tunnel excavation device. The hydraulic telescopic cylinder is horizontally fixed above the moving base, and is connected to the tunnel mold through a connector. A shape of the tunnel mold is consistent with the shape of the tunnel excavation port, but a size of the tunnel mold is slightly smaller than a size of the tunnel excavation port. The tunnel mold is configured to enter and leave freely under the traction of the hydraulic telescopic cylinder. The interior of the tunnel mold is hollow, and a camera is configured to enter a tunnel excavation space from the outside of the experimental cabin to collect real-time images of a whole process of the tunnel excavation.

Preferably, the experimental control system includes a servo system and a control center. The servo loading system includes a load and displacement dual control servo system and a water pressure and water flow dual control servo system. The load and displacement dual control servo system is configured to realize dual control of load and displacement. The vertical loading cylinder and the horizontal loading cylinder are controlled by the load and displacement dual control servo system to respectively provide the vertical load and the horizontal load for the physical model in the experimental cabin, so as to meet requirements of different simulation environments. The water pressure and water flow dual control servo system is configured to realize dual control of water pressure and water flow, which can not only provide stable water flow supply to a cave in the physical model, but also maintain a constant water pressure in the cave in the physical model. In a whole process, the control center is configured to realize automatic control of the servo system, and real-time monitoring and collection of the displacement, the load, the water pressure and the water flow. A data collection frequency is set according to actual needs. In addition, according to requirements of the experiment, monitoring elements, such as a pore water pressure sensor, an earth pressure sensor and a displacement sensor, are added in the physical model.

An experimental method of the experimental system for the surrounding rock crack evolution and the water inrush disaster change in the tunnel excavation of the near-covered karst cave includes the following steps:

S1: according to a comprehensive bar chart of strata and physical and mechanical test results of each stratum, obtaining a lithology, a thickness and physical and mechanical parameters of each stratum; according to a geometric similarity ratio and a stress similarity ratio, determining a geometric size and a spatial position of a tunnel and a covered karst cave in a model, a geometric size of each stratum, and a proportion of a similar material, where the similar material is a mixture of various hydrophobic materials;

S2: starting the lifting hydraulic cylinders above the mobile lifting wheels to lift the whole experimental cabin by 3 to 5 mm away from the base; starting the horizontal pushing hydraulic cylinder to horizontally move the whole experimental cabin out of the reaction frame; then, stopping the lifting hydraulic cylinders to allow the experimental cabin to fall back to the guide rails, such that a weight of the experimental cabin and the physical model is borne by the guide rails, so as to improve a safety of the guide rails in a process of laying the model;

S3: in the experimental cabin, adopting the similar material to lay the model of the strata; designing a shape, a size and a position of the tunnel mold and a covered karst cave mold based on the geometric size and the spatial position of the tunnel and the covered karst cave, and placing the tunnel mold and the covered karst cave mold in the model in the process of laying the model; where a manufacturing process of the covered karst cave mold is as follows: according to a shape and a size of the covered karst cave, the covered karst cave is copied by a 3D printer, and the copied covered karst cave mold is in a form of a thin-walled cavity, and the cavity of the mold is fully filled with water; the mold is placed in a low-temperature cabinet to allow water to be condensed into ice, and the ice obtained after the mold is removed presents the same shape and size as the covered karst cave; according to the spatial position of the covered karst cave, the ice is placed in the model in the process of laying the model, and at the same time, an external pressure-bearing water pipe is connected to the water pressure and water flow dual control servo system, and is configured to adjust the water pressure and the water flow in the covered karst cave; the ice in the shape of the covered karst cave forms an effective support to the surrounding rock mass to avoid collapse in the process of laying the model; in order to prevent the ice from melting, preferably, the temperature is lower than 0° C. in the process of laying the model;

S4: starting the lifting hydraulic cylinders above the mobile lifting wheels to lift the whole experimental cabin by 3 to 5 mm away from the guide rails after the laying of the model is completed; starting the horizontal pushing hydraulic cylinder to horizontally move the whole experimental cabin back to the inside of the reaction frame; then, stopping the lifting hydraulic cylinders to allow the experimental cabin to fall back to the base; and starting the load and displacement dual control servo system to apply predetermined vertical and horizontal loads to the physical model to simulate an original stress environment of the strata; where in order to reduce the damage to the physical model caused by load loading, preferably, the vertical load and the horizontal load are applied by hierarchical loading;

S5: starting the water pressure and water flow dual control servo system to provide and maintain a predetermined water pressure to the covered karst cave, and then adjusting an ambient temperature of the experimental cabin to above 0° C. to facilitate the melting of the ice in the covered karst cave; where after the ice completely melts, the covered karst cave consistent with the actual shape and fully filled with a certain pressure water is formed; at this time, a pressurized water body in the covered karst cave forms an effective support to the surrounding rock mass;

S6: starting the hydraulic telescopic cylinder on the tunnel excavation device to drag the tunnel mold out of the physical model according to a predetermined speed, so as to simulate a step-by-step excavation of the tunnel; at the same time, allowing the camera, which is configured to enter, leave and rotate freely through an inside of the tunnel mold, to enter the tunnel excavation space from the outside of the experimental cabin to collect the real-time images of the whole process of the tunnel excavation;

S7: as a tunnel face approaches the covered karst cave, under the superposition of a stress of the surrounding rock mass and a water pressure in the covered karst cave to a waterproof rock mass, generating new cracks, expanding original cracks, and allowing confined water in the covered karst caves to quickly enter the tunnel along crack channels to cause a water inrush disaster; and S8: when the excavation of the tunnel is completed, controlling the water pressure and water flow dual control servo system to stop the water supply, controlling the load and displacement dual control servo system to reset the horizontal loading cylinder and the horizontal loading cylinder, detaching the front side plate of the experimental cabin from the experimental cabin, and starting the horizontal push hydraulic cylinder to separate the front side plate from the whole experimental cabin; where deformation and damage of the front side of the physical model can be directly observed, and alternatively, the physical model can be subjected to cross-sectional cutting and observed according to the requirements of the experiment.

Compared with the prior art, the present invention has the following advantages:

The present invention provides an experimental system for surrounding rock crack evolution and water inrush disaster change in a tunnel excavation of a near-covered karst cave and an experimental method thereof. By setting a tunnel excavation device instead of the manual excavation of a physical model, the step-by-step excavation of the tunnel is realized, and the hindrance of falling broken rock to the smooth excavation of the tunnel is effectively avoided. The covered karst cave mold is obtained by 3D printing. Due to the characteristic that water is condensed into ice below 0° C. and melted into water above 0° C., water is injected into the covered karst cave mold, which is condensed into ice by low temperature treatment and then buried in the physical model, so as to form an effective support to the surrounding rock mass to avoid the collapse in a process of laying the mode. Then, through heating treatment, the ice in the covered karst cave is melted. Finally, the covered karst cave consistent with the actual shape and fully filled with a certain pressure water is formed. The camera, which is configured to enter, leave and rotate freely through the inside of the tunnel mold, enters the tunnel excavation space from the outside of the experimental cabin to collect the real-time images of the whole process of the tunnel excavation. By separating the front side plate from the whole experimental cabin, the deformation and damage of the front side of the physical model can be directly observed, and alternatively, the physical model is subjected to cross-sectional cutting and observed according to the requirements of the experiment.

Figure 1:
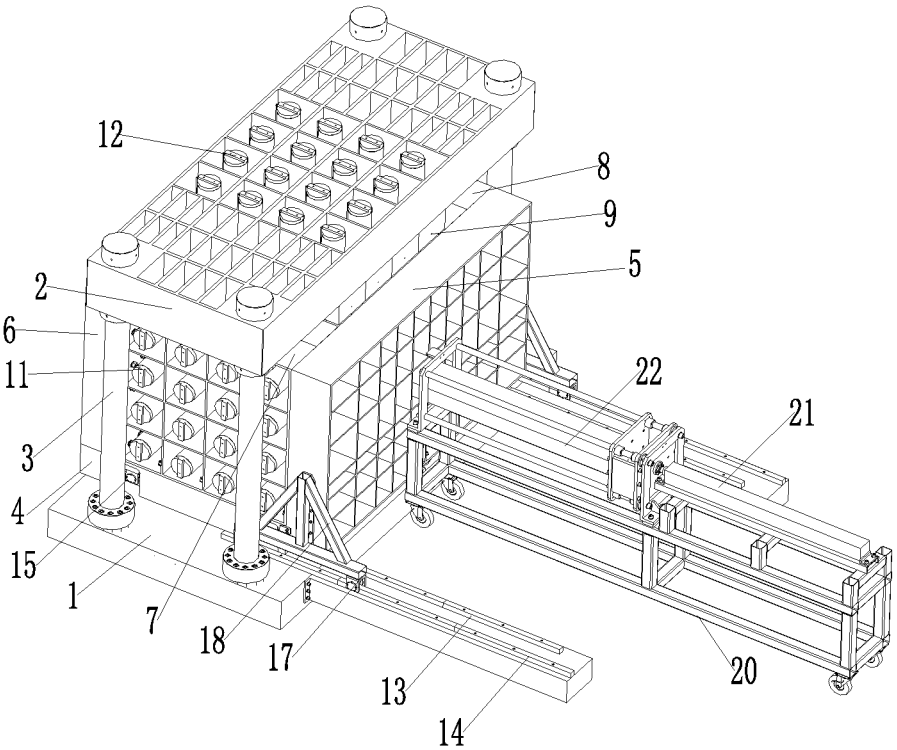
FIG. 1 is a top view of a structure of the present invention.

In the figures: base 1, upper crossbeam 2, standing column 3, bottom plate 4, front side plate 5, rear side plate 6, left side plate 7, right side plate 8, top plate 9, tunnel excavation port 10, horizontal loading cylinder 11, vertical loading cylinder 12, inner guide rail 13, outer guide rail 14, mobile lifting wheel 15, horizontal pushing hydraulic cylinder 16, ordinary moving wheel 17, triangular gantry 18, limiter 19, moving base 20, hydraulic telescopic cylinder 21, and tunnel mold 22.

DETAILED DESCRIPTION OF THE EMBODIMENTS

The technical solution in the embodiments of the present invention is clearly and completely described below. In view of the embodiments of the present invention, all other embodiments obtained by those having ordinary skill in the art without creative work shall fall within the scope of the protection of the present invention.

Figure 2:
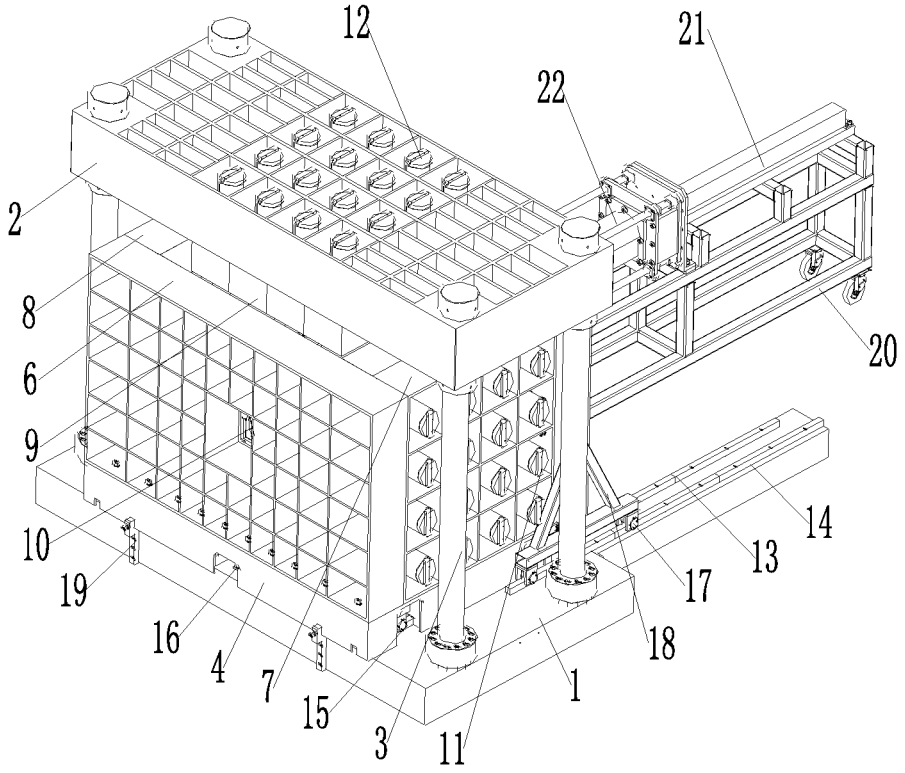
FIG. 2 is a left view of the structure of the present invention.
Figure 3:
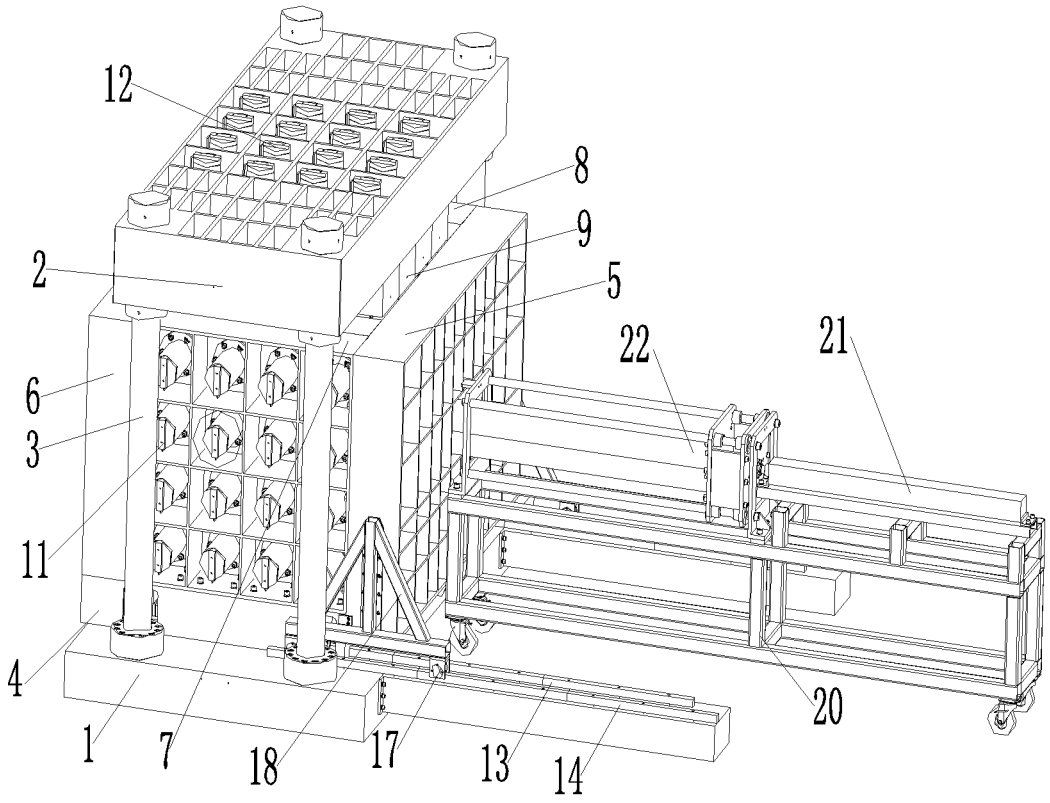
FIG. 3 is a right view of the structure of the present invention.

Referring to FIGS. 1-3, the present invention provides the following technical solution. An experimental system for surrounding rock crack evolution and water inrush disaster change in a tunnel excavation of a near-covered karst cave includes the base 1, the upper crossbeam 2, the standing columns 3, an experimental cabin, guide rails, a tunnel excavation device and an experimental control system.

The standing columns 3 are symmetrically arranged on the base 1, one end of each of the standing columns 3 is inserted in the base 1, and the other end of each of the standing columns 3 penetrates the upper crossbeam 2 to form a reaction frame.

The experimental cabin includes a bottom plate 4, a front side plate 5, a rear side plate 6, a left side plate 7, a right side plate 8 and a top plate 9. The bottom plate 4 of the experimental cabin is placed directly on the base 1. The front side plate 5 and the rear side plate 6 are symmetrically arranged on symmetrical sides of the base 1, respectively. The left side plate 7 and the right side plate 8 are symmetrically arranged on the other symmetrical sides of the base 1, respectively. A tunnel excavation port 10 is symmetrically arranged at the middle position of the front side plate 5 and the rear side plate 6, and the shape of the tunnel excavation port 10 may be set according to the actual shape of a tunnel. The left side plate 7 and the right side plate 8 are symmetrically provided with equidistant installation grooves for installing the horizontal loading cylinder 11. The horizontal loading pressure head is installed on the loading cylinder, and the horizontal loading pressure head directly provides a horizontal load for a physical model in the experimental cabin. The top plate 9 is centered symmetrically and equidistantly, and is connected to a vertical loading pressure head of the vertical loading cylinder 12. The vertical loading pressure head directly provides a vertical load for the physical model in the experimental cabin. The vertical loading cylinder 12 is installed on the upper crossbeam 2. In the process of performing horizontal and vertical loading on the physical model at the same time, in order to avoid that the horizontal loading pressure head and the vertical loading pressure head squeeze each other, the left and right sizes of the vertical loading pressure head are smaller than the left and right sizes of the experimental cabin. However, in order to improve the overall tightness of the experimental cabin, a closed baffle is installed above the inside of the left side plate 7 and the right side plate 8, and is fixed on the left side plate 7 and the right side plate 8 by bolts.

The guide rails include a set of inner guide rails and a set of outer guide rails. The inner guide rails 13 are configured to move the whole the experimental cabin, and the outer guide rails 14 are configured for the separate movement of the front side plate 5 of the experimental cabin. The set of inner guide rails is symmetrically fixed on two sides of the base 1, and the set of outer guide rails is symmetrically fixed on two sides of the base 1. Mobile lifting wheels 15 are respectively arranged on the inner guide rails 13, and the mobile lifting wheels 15 are symmetrically fixed on the bottom plate 4 of the experimental cabin. When the whole experimental cabin is required to be moved, the lifting hydraulic cylinders above the mobile lifting wheels 15 are started to lift the whole experimental cabin by 3 to 5 mm away from the base 1. At this time, the experimental cabin is completely supported by the mobile lifting wheels 15, the horizontal pushing hydraulic cylinder 16 is started, and the whole experimental cabin is horizontally moved by relying on the telescopic action of the horizontal pushing hydraulic cylinder 16. Ordinary moving wheels 17 are arranged on the outer guide rail 14, and the ordinary moving wheels 17 are symmetrically fixed at the bottom of the triangular gantry 18. The triangular gantries 18 are fixed on the left and right sides of the front side plate 5 by bolts. After the experiment of the physical model is completed, without damaging the physical model, the front side plate 5 may be driven by the ordinary moving wheels 17 to be separated from the experimental cabin, such that the front side of the physical model is observed directly. In order to prevent the pressure head from failing to be centered in the vertical loading process due to the back and forth movement of the experimental cabin, preferably, the limiter 19 is arranged on the base 1 for positioning the experimental cabin.

The tunnel excavation device includes the moving base 20, the hydraulic telescopic cylinder 21 and the tunnel mold 22. Universal wheels are symmetrically arranged at the bottom of the moving base 201 to facilitate the free adjustment of the position of the tunnel excavation device. The hydraulic telescopic cylinder 21 is horizontally fixed above the moving base 20, and is connected to the tunnel mold 22 through a connector. The shape of the tunnel mold 22 is consistent with the shape of the tunnel excavation port 10, but the size of the tunnel mold 22 is slightly smaller than the size of the tunnel excavation port 10. The tunnel mold 22 is configured to enter and leave freely under the traction of the hydraulic telescopic cylinder 21. The interior of the tunnel mold 22 is hollow, and the camera is configured to enter the tunnel excavation space from the outside of the experimental cabin to collect real-time images of the whole process of the tunnel excavation.

The experimental control system includes a servo system and a control center. The servo loading system includes a load and displacement dual control servo system and a water pressure and water flow dual control servo system. The load and displacement dual control servo system is configured to realize the dual control of load and displacement. The horizontal loading cylinder 12 and the horizontal loading cylinder 11 are controlled by the load and displacement dual control servo system to respectively provide the vertical load and the horizontal load for the physical model in the experimental cabin, so as to meet the requirements of different simulation environments. The water pressure and water flow dual control servo system is configured to realize the dual control of water pressure and water flow, which can not only provide stable water flow supply to a cave in the physical model, but also maintain the constant water pressure in the cave in the physical model. In the whole process, the control center is configured to realize automatic control of the servo system, and real-time monitoring and collection of the displacement, the load, the water pressure and the water flow. A data collection frequency can be set according to the actual needs. In addition, according to the requirements of the experiment, monitoring elements, such as a pore water pressure sensor, an earth pressure sensor and a displacement sensor, are added in the physical model.

The process of the experiment:

According to the comprehensive bar chart of strata and the physical and mechanical test results of each stratum, the lithology, thickness and physical and mechanical parameters of each stratum are obtained. According to a geometric similarity ratio and a stress similarity ratio, a geometric size and a spatial position of a tunnel and a covered karst cave in the model, a geometric size of each stratum, and a proportion of a similar material are determined. The similar material is a mixture of various hydrophobic materials. The lifting hydraulic cylinders above the mobile lifting wheels 15 are started to lift the whole experimental cabin by 3 to 5 mm away from the base 1. The horizontal pushing hydraulic cylinder 16 is started to horizontally move the whole experimental cabin out of the reaction frame. Then, the lifting hydraulic cylinders are stopped to allow the experimental cabin to fall back to the guide rails, such that the weight of the experimental cabin and the physical model is borne by the guide rails, so as to improve the safety of the guide rails in the process of laying the model.

In the experimental cabin, the similar material is adopted to lay the model of the strata. The shape, size and position of the tunnel mold 22 and a covered karst cave mold are designed based on the geometric size and the spatial position of the tunnel and the covered karst cave, and the tunnel mold 22 and the covered karst cave mold are placed in the model in the process of laying the model. The manufacturing process of the covered karst cave mold is as follows: according to the shape and size of the covered karst cave, the covered karst cave is copied by a 3D printer, and the copied covered karst cave mold is in the form of a thin-walled cavity, and the cavity of the mold is fully filled with water. The mold is placed in a low-temperature cabinet to allow water to be condensed into ice, and the ice obtained after the mold is removed presents the same shape and size as the covered karst cave. According to the spatial position of the covered karst cave, the ice is placed in the model in the process of laying the model, and at the same time, an external pressure-bearing water pipe is connected to the water pressure and water flow dual control servo system, and is configured to adjust the water pressure and the water flow in the covered karst cave. The ice in the shape of the covered karst cave forms an effective support to the surrounding rock mass to avoid collapse in the process of laying the model. In order to prevent the ice from melting, preferably, the temperature should be lower than 0° C. in the process of laying the model. The lifting hydraulic cylinders above the mobile lifting wheels 15 are started to lift the whole experimental cabin by 3 to 5 mm away from the guide rails after the laying of the model is completed. The horizontal pushing hydraulic cylinder 16 is started to horizontally move the whole experimental cabin back to the inside of the reaction frame. Then, the lifting hydraulic cylinders are stopped to allow the experimental cabin to fall back to the base 1. The load and displacement dual control servo system is started to apply predetermined vertical and horizontal loads to the physical model to simulate an original stress environment of the strata. In order to reduce the damage to the physical model caused by load loading, preferably, the vertical load and the horizontal load are applied by hierarchical loading.

The water pressure and water flow dual control servo system is stared to provide and maintain a predetermined water pressure to the covered karst cave, and then adjusting an ambient temperature of the experimental cabin to above 0° C. to facilitate the melting of the ice in the covered karst cave. After the ice completely melts, the covered karst cave consistent with the actual shape and fully filled with a certain pressure water is formed. At this time, the pressurized water body in the covered karst cave forms an effective support to the surrounding rock mass. The hydraulic telescopic cylinder 21 on the tunnel excavation device is started to drag the tunnel mold 22 out of the physical model according to a predetermined speed, so as to simulate the step-by-step excavation of the tunnel. At the same time, the camera, which is configured to enter, leave and rotate freely through the inside of the tunnel mold 22, enters the tunnel excavation space from the outside of the experimental cabin to collect real-time images of the whole process of the tunnel excavation. As the tunnel face approaches the covered karst cave, under the superposition of the stress of the surrounding rock mass and the water pressure in the covered karst cave to a waterproof rock mass, generating new cracks, expanding original cracks, and allowing confined water in the covered karst caves to quickly enter the tunnel along crack channels to cause the water inrush disaster.

When the excavation of the tunnel is completed, the water pressure and water flow dual control servo system is controlled to stop the water supply, the load and displacement dual control servo system is controlled to reset the horizontal loading cylinder 12 and the horizontal loading cylinder 11, the front side plate 5 of the experimental cabin is detached from the experimental cabin, and the horizontal push hydraulic cylinder 16 is started to separate the front side plate 5 from the whole experimental cabin. In this way, the deformation and damage of the front side of the physical model can be directly observed, and alternatively, the physical model is subjected to cross-sectional cutting and observed according to the requirements of the experiment.

Although embodiments of the present invention have been shown and described, for those having ordinary skill in the art, it should be understood that a variety of changes, modifications, replacements and variants may be made to these embodiments without departing from the principle and spirit of the present invention, and the scope of the present invention is limited by the attached claims and their equivalents.

What is claimed is:

1. An experimental system for surrounding rock crack evolution and water inrush disaster change in a tunnel excavation of a near-covered karst cave, comprising a base (1), an upper crossbeam (2), standing columns (3), an experimental cabin, guide rails, a tunnel excavation device and an experimental control system; and the standing columns (3) are symmetrically and fixedly arranged on the base (1), one end of each of the standing columns (3) is inserted in the base (1), and the other end of each of the standing columns (3) penetrates the upper crossbeam (2) to form a reaction frame;

wherein the experimental cabin comprises a bottom plate (4), a front side plate (5), a rear side plate (6), a left side plate (7), a right side plate (8) and a top plate (9); wherein the bottom plate (4) of the experimental cabin is placed directly on the base (1); the front side plate (5) and the rear side plate (6) are symmetrically arranged on symmetrical sides of the base (1), respectively; the left side plate (7) and the right side plate (8) are symmetrically arranged on the other symmetrical sides of the base (1), respctively; a tunnel excavation port (10) is symmetrically arranged at a middle position of the front side plate (5) and the rear side plate (6), and a shape of the tunnel excavation port (10) is set according to an actual shape of a tunnel; the left side plate (7) and the right side plate (8) are symmetrically provided with equidistant installation grooves for installing a horizontal loading cylinder (11); a horizontal loading pressure head is fixedly installed on the loading cylinder, and the horizontal loading pressure head directly provides a horizontal load for a physical model in the experimental cabin; the top plate (9) is centred symmetrically, equidistantly and fixedly, and is connected to a vertical loading pressure head of the vertical loading cylinder (12); the vertical loading pressure head directly provides a vertical load for the physical model in the experimental cabin; the vertical loading cylinder (12) is fixedly installed on the upper crossbeam (2); in a process of performing horizontal and vertical loading on the physical model at a same time, in order to avoid that the horizontal loading pressure head and the vertical loading pressure head squeeze each other, left and right sizes of vertical loading pressure head are smaller than left and right sizes of the experimental cabin; however, in order to improve an overall tightness of the experimental cabin, a closed baffle is installed above an inside of the left side plate (7) and the right side plate (8), and is fixed on the left side plate (7) and the right side plate (8) by bolts;

the guide rails comprise a set of inner guide rails and a set of outer guide rails; wherein the inner guide rails (13) are configured for an overall movement of the experimental cabin, and the outer guide rails (14) are configured for a separate movement of the front side plate (5) of the experimental cabin; the set of inner guide rails is symmetrically fixed on two sides of the base (1), and the set of outer guide rails is symmetrically fixed on two sides of the base (1); mobile lifting wheels (15) are respectively arranged on the inner guide rails (13), and the mobile lifting wheels (15) are symmetrically fixed on the bottom plate (4) of the experimental cabin; when the whole experimental cabin is required to be moved, the lifting hydraulic cylinders above the mobile lifting wheels (15) are started to lift the whole experimental cabin by 3 to 5 mm away from the base (1); at this time, the experimental cabin is completely supported by the mobile lifting wheels (15), a horizontal pushing hydraulic cylinder (16) is started, and the whole experimental cabin is horizontally moved by relying on a telescopic action of the horizontal pushing hydraulic cylinder (16); ordinary moving wheels (17) are arranged on the outer guide rail (14), and the ordinary moving wheels (17) are symmetrically fixed at a bottom of a triangular gantry (18); the triangular gantries (18) are fixed on left and right sides of the front side plate (5) by bolts; after an experiment of the physical model is completed, without damaging the physical model, the front side plate (5) is driven by the ordinary moving wheels (17) to be separated from the experimental cabin, such that a front side of the physical model is observed directly; in order to prevent the pressure head from failing to be centred in a vertical loading process due to back and forth movement of the experimental cabin, preferably, a limiter (19) is arranged on the base (1) for positioning the experimental cabin.

2. The experimental system for the surrounding rock crack evolution and the water inrush disaster change in the tunnel excavation of the near-covered karst cave according to claim 1, wherein the tunnel excavation device comprises a moving base (20), a hydraulic telescopic cylinder (21) and a tunnel mold (22); wherein universal wheels are symmetrically arranged at a bottom of the moving base (201) to facilitate a free adjustment of a position of the tunnel excavation device; the hydraulic telescopic cylinder (21) is horizontally fixed above the moving base (20), and is connected to the tunnel mold (22) through a connector; a shape of the tunnel mold (22) is consistent with the shape of the tunnel excavation port (10), but a size of the tunnel mold (22) is slightly smaller than a size of the tunnel excavation port (10); the tunnel mold (22) is configured to enter and leave freely under a traction of the hydraulic telescopic cylinder (21); an interior of the tunnel mold (22) is hollow, and a camera is configured to enter a tunnel excavation space from an outside of the experimental cabin to collect real-time images of a whole process of the tunnel excavation.

3. The experimental system for the surrounding rock crack evolution and the water inrush disaster change in the tunnel excavation of the near-covered karst cave according to claim 2, wherein the experimental control system comprises a servo system and a control center; the servo system comprises a load and displacement dual control servo system and a water pressure and water flow dual control servo system; wherein the load and displacement dual control servo system is configured to realize dual control of load and displacement; the vertical loading cylinder (12) and the horizontal loading cylinder (11) are controlled by the load and displacement dual control servo system to respectively provide the vertical load and the horizontal load for the physical model in the experimental cabin, so as to meet requirements of different simulation environments; the water pressure and water flow dual control servo system is configured to realize dual control of water pressure and water flow, which can not only provide stable water flow supply to a cave in the physical model, but also maintain a constant water pressure in the cave in the physical model; in a whole process, the control center is configured to realize automatic control of the servo system, and real-time monitoring and collection of the displacement, the load, the water pressure and the water flow; a data collection frequency is set according to actual needs; in addition, according to requirements of the experiment, monitoring elements, such as a pore water pressure sensor, an earth pressure sensor and a displacement sensor, are added in the physical model.

4. An experimental method of the experimental system for the surrounding rock crack evolution and the water inrush disaster change in the tunnel excavation of the near-covered karst cave according to claim 3, comprising the following steps:

S1: according to a comprehensive bar chart of strata and physical and mechanical test results of each stratum, obtaining a lithology, a thickness and physical and mechanical parameters of each stratum; according to a geometrie similarity ratio and a stress similarity ratio, determining a geometric size and a spatial position of a tunnel and a covered karst cave in a model, a geometric size of each stratum, and a proportion of a similar material, wherein the similar material is a mixture of various hydrophobic materials;

S2: starting the lifting hydraulic cylinders above the mobile lifting wheels (15) to lift the whole experimental cabin by 3 to 5 mm away from the base (1); starting the horizontal pushing hydraulic cylinder (16) to horizontally move the whole experimental cabin out of the reaction frame; then, stopping the lifting hydraulic cylinders to allow the experimental cabin to fall back to the guide rails, such that a weight of the experimental cabin and the physical model is borne by the guide rails, so as to improve a safety of the guide rails in a process of laying the model;

S3: in the experimental cabin, adopting the similar material to lay the model of the strata; designing a shape, a size and a position of the tunnel mold (22) and a covered karst cave mold based on the geometric size and the spatial position of the tunnel and the covered karst cave, and placing the tunnel mold (22) and the covered karst cave mold in the model in the process of laying the model; wherein a manufacturing process of the covered karst cave mold is as follows: according to a shape and a size of the covered karst cave, the covered karst cave is copied by a 3D printer, and the copied covered karst cave mold is in a form of a thin-walled cavity, and the cavity of the mold is fully filled with water; the mold is placed in a low-temperature cabinet to allow water to be condensed into ice, and the ice obtained after the mold is removed presents the same shape and size as the covered karst cave; according to the spatial position of the covered karst cave, the ice is placed in the model in the process of laying the model, and at the same time, an external pressure-bearing water pipe is connected to the water pressure and water flow dual control servo system, and is configured to adjust the water pressure and the water flow in the covered karst cave; the ice in the shape of the covered karst cave forms an effective support to the surrounding rock mass to avoid collapse in the process of laying the model; in order to prevent the ice from melting, preferably, the temperature is lower than 0° C. in the process of laying the model;

S4: starting the lifting hydraulic cylinders above the mobile lifting wheels (15) to lift the whole experimental cabin by 3 to 5 mm away from the guide rails after the laying of the model is completed; starting the horizontal pushing hydraulic cylinder (16) to horizontally move the whole experimental cabin back to an inside of the reaction frame; then, stopping the lifting hydraulic cylinders to allow the experimental cabin to fall back to the base (1); and starting the load and displacement dual control servo system to apply predetermined vertical and horizontal loads to the physical model to simulate an original stress environment of the strata; wherein in order to reduce a damage to the physical model caused by load loading, preferably, the vertical load and the horizontal load are applied by hierarchical loading;

S5: starting the water pressure and water flow dual control servo system to provide and maintain a predetermined water pressure to the covered karst cave, and then adjusting an ambient temperature of the experimental cabin to above 0° C. to facilitate a melting of the ice in the covered karst cave; wherein after the ice completely melts, the covered karst cave consistent with the actual shape and fully filled with a certain pressure water is formed; at this time, a pressurized water body in the covered karst cave forms an effective support to the surrounding rock mass;

S6: starting the hydraulic telescopic cylinder (21) on the tunnel excavation device to drag the tunnel mold (22) out of the physical model according to a predetermined speed, so as to simulate a step-by-step excavation of the tunnel; at the same time, allowing the camera, which is configured to enter, leave and rotate freely through an inside of the tunnel mold (22), to enter the tunnel excavation space from the outside of the experimental cabin to collect the real-time images of the whole process of the tunnel excavation;

S7: as a tunnel face approaches the covered karst cave, under a superposition of a stress of the surrounding rock mass and a water pressure in the covered karst cave to a waterproof rock mass, generating new cracks, expanding original cracks, and allowing confined water in the covered karst caves to quickly enter the tunnel along crack channels to cause a water inrush disaster; and S8: when the excavation of the tunnel is completed, controlling the water pressure and water flow dual control servo system to stop the water supply, controlling the load and displacement dual control servo system to reset the vertical loading cylinder (12) and the horizontal loading cylinder (11), detaching the front side plate (5) of the experimental cabin from the experimental cabin, and starting the horizontal push hydraulic cylinder (16) to separate the front side plate (5) from the whole experimental cabin; wherein deformation and damage of the front side of the physical model can be directly observed, and alternatively, the physical model is subjected to cross-sectional cutting and observed according to the requirements of the experiment.

* * * * *